US009343204B2

(12) United States Patent
Clement et al.

(10) Patent No.: US 9,343,204 B2
(45) Date of Patent: May 17, 2016

(54) ELECTRICAL INSULATOR APPARATUS AND METHODS OF RETAINING AN ELECTRICAL CONDUCTOR WITH AN ELECTRICAL INSULATOR APPARATUS

(71) Applicant: Marmon Utility, LLC, Milford, NH (US)

(72) Inventors: Charles J. Clement, Pelham, NH (US); Guberson Mercedat, North Andover, MA (US); Michael L. Williams, Newburyport, MA (US); May Cho, Sudbury, MA (US); Leonard P. Jean, Melbourne, FL (US)

(73) Assignee: Marmon Utility, LLC, Milford, NH (US)

( * ) Notice: Subject to any disclaimer, the term of this patent is extended or adjusted under 35 U.S.C. 154(b) by 380 days.

(21) Appl. No.: 13/895,934

(22) Filed: May 16, 2013

(65) Prior Publication Data

US 2013/0306355 A1 Nov. 21, 2013

Related U.S. Application Data

(60) Provisional application No. 61/647,754, filed on May 16, 2012.

(51) Int. Cl.
*H01B 17/16* (2006.01)
*H01B 17/22* (2006.01)

(52) U.S. Cl.
CPC ..... *H01B 17/16* (2013.01); *H01B 17/22* (2013.01)

(58) Field of Classification Search
CPC ..... H01B 17/16
USPC ..... 174/168–169, 135, 152 G, 153 G, 137 R, 174/138 R, 138 F, 142
See application file for complete search history.

(56) References Cited

U.S. PATENT DOCUMENTS

| | | | | |
|---|---|---|---|---|
| 3,586,758 | A * | 6/1971 | Harmon et al. | 174/158 R |
| 4,134,574 | A | 1/1979 | Jean et al. | |
| 4,178,470 | A * | 12/1979 | Jean et al. | 174/168 |
| 4,258,228 | A * | 3/1981 | Jean et al. | 174/168 |
| 7,432,449 | B2 * | 10/2008 | Kim | H01B 17/16 174/138 F |
| 7,588,224 | B2 * | 9/2009 | Bernstorf et al. | 248/229.22 |

* cited by examiner

*Primary Examiner* — Jenny L Wagner
*Assistant Examiner* — Michael P McFadden
(74) *Attorney, Agent, or Firm* — Hayes Soloway, P.C.

(57) ABSTRACT

An electrical insulator apparatus and methods of using the same are provided. The apparatus includes an insulator body formed about a central axis, the insulator body having a plurality of spaced fins positioned along an exterior of the insulator body. A first jaw portion is positioned on an upper portion of the insulator body. A second jaw portion is positioned proximate to the first jaw portion and is movable with respect to the first jaw portion. At least one fastener is connected between the first and second jaw portions. A jaw platform is positioned at least partially between the first and second jaw portions, wherein the first and second jaw portions and the jaw platform form a notch sized to receive an electrical conductor, wherein the jaw platform substantially lies within a first plane angled substantially between 6° and 184° with respect to the central axis of the insulator body.

30 Claims, 11 Drawing Sheets

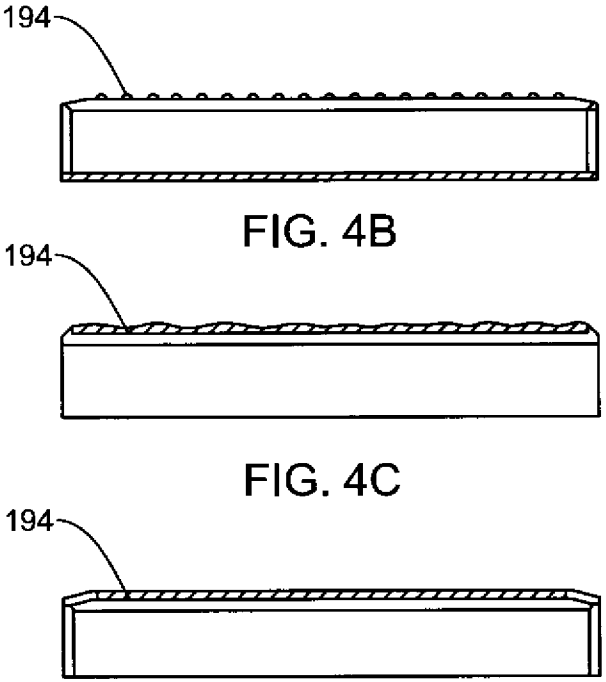
FIG. 4B
FIG. 4C
FIG. 4D
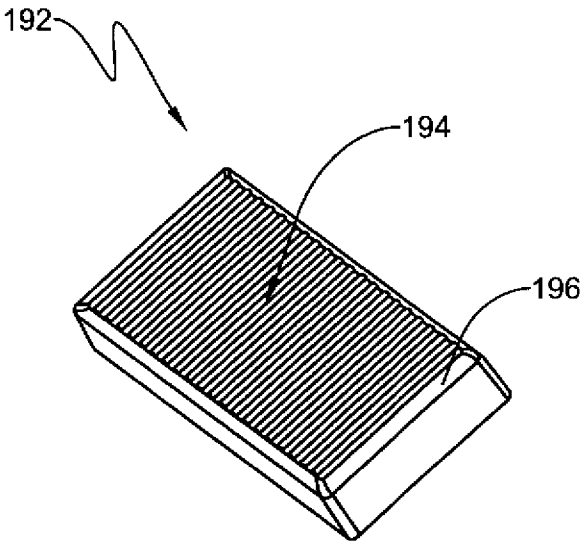
FIG. 4A

Tangent

Angled

Tangent

Angled

ELECTRICAL INSULATOR APPARATUS AND METHODS OF RETAINING AN ELECTRICAL CONDUCTOR WITH AN ELECTRICAL INSULATOR APPARATUS

CROSS REFERENCE TO RELATED APPLICATION

This application claims benefit of U.S. Provisional Application Ser. No. 61/647,754, entitled, "Angled Insulator For Electrical Conductors And Methods Of Using The Same" filed May 16, 2012, the entire disclosure of which is incorporated herein by reference.

FIELD OF THE DISCLOSURE

The present disclosure is generally related to overhead distribution and transmission insulators and more particularly is related to electrical insulator apparatus and methods of retaining an electrical conductor with an electrical insulator apparatus.

BACKGROUND OF THE DISCLOSURE

Insulators are used with electrical transmission and distribution systems to isolate and support electrical conductors above the ground for overhead power distribution and transmission. Tie-wire and clamping mechanisms are used to secure and hold electrical conductors that are strung between utility poles in a variety of common configurations, such as roadside (tangent) or road crossing (angled) spans between the utility poles. For tangent and small angle configurations, typically up to 5°, the electrical conductors are supported on the top portion of the insulator, known as the top saddle. On angled configurations, typically greater than 5°, the electrical conductors are supported on the side portion of the insulator, known as the neck or side saddle. For the most part these needs have been met by use of a tie-wire, a pre-formed tie-wire, a clamp-top fitting, or an integral vise-top.

Tie-wire is a low-cost material, but may not achieve the desired conductor grip strength due to variation in hand-tying methods by installation personnel. It may also lack consistency in grip strength from one location to the next although the same tying method is utilized. Another deficiency of tie-wire is the required method of wrapping the wire about the neck of the insulator effectively reduces the electrical resistance path to ground. Preformed tie-wire overcomes the tie-wire deficiency in strength and consistency, but shares the issue of reducing the resistance path to ground. Preformed tie-wires carry a higher per unit cost and also require several different models to accommodate the wide range of conductor sizes and configurations used in the field.

Clamp-top fittings typically consist of a metal bracket for attachment to the insulator neck and an additional metallic assembly to keep and clamp the conductor. Clamp-top fittings generally accept a wide range of conductor sizes, but still require multiple models to cover the full range of conductor sizes and insulator neck sizes. There is a high per unit cost and a high installation cost when compared to ties. Their top saddle position also raises the conductor some distance (e.g. 3-inch) above the normal conductor mounting position which can increase the moment (force) applied to mounting hardware in small angle configurations. This has the drawback of forcing the user to shift the installation to a side-saddle position, with an associated reduction in resistance path to ground and dry-arc distance, for small angles that would otherwise be accommodated in the top saddle position by tie-wire methods.

Vise-top insulators are generally formed on insulator bodies having opposing jaws positioned at the top of the insulator body. The opposing jaws include at least one jaw piece that is adjustable relative to the other jaw piece, such that the jaw pieces can be clamped on an electrical conductor therebetween and retain it in place. Vise-top insulators overcome many of the deficiencies cited for devices above by accommodating a wide range of conductor sizes in a single model. However, the conductor grip strength is generally less than that of preformed ties and clamp-top fittings.

There has long been a need to reliably and economically secure a wide range of electrical conductor sizes to the insulator. Conventional insulators and associated ties or clamps, as cited above, generally accommodate the reliability aspects of tangent configurations. However, for angled configurations typically greater than 5° the electrical conductors are supported on the side saddle and these conventional insulators often are unable to provide the necessary mechanical and electrical support to ensure safe and proper functioning of the electrical conductor over the expected lifetime. They are also unable to provide the flexibility within one device to accommodate the wide range of conductor sizes, types, configurations and grip strength requirements.

Thus, a heretofore unaddressed need exists in the industry to address the aforementioned deficiencies and inadequacies.

SUMMARY OF THE DISCLOSURE

Embodiments of the present disclosure provide an electrical insulator apparatus. Briefly described, in architecture, one embodiment of the apparatus, among others, can be implemented as follows. An insulator body is formed about a central axis, the insulator body having an internal cavity and a plurality of spaced fins positioned along an exterior of the insulator body. A first jaw portion is positioned on the insulator body. A second jaw portion is connected to the first jaw portion. At least one fastener is connected between the first and second jaw portions. A jaw platform has a platform surface, wherein the platform surface is formed at least partially between the first and second jaw portions, and wherein a plane substantially aligned with the platform surface intersects the internal cavity.

The present disclosure can also be viewed as providing an electrical insulator apparatus for side-saddle mounting of a conductor. Briefly described, in architecture, one embodiment of the apparatus, among others, can be implemented as follows. An insulator body is formed about a central axis, the insulator body having an threaded internal cavity sized to receive a mounting pin. A plurality of spaced fins is positioned radially about the threaded internal cavity along an exterior of the insulator body. A first jaw portion is formed integral with the insulator body. A second jaw portion is movably engaged to the first jaw portion. A jaw platform is formed between the first and second jaw portions and having a substantially planar platform surface, wherein the first jaw portion, the second jaw portion, and the jaw platform form a conductor-receiving notch, and wherein a plane substantially aligned with the substantially planar platform surface intersects the internal cavity. A first threaded fastener is engaged between the first and second jaw portions in a position above the substantially planar platform surface. A second threaded fastener is engaged between the first and second jaw portions in a position below the substantially planar platform surface.

The present disclosure can also be viewed as providing methods of retaining an electrical conductor with an electrical insulator apparatus. In this regard, one embodiment of such a method, among others, can be broadly summarized by the following steps: securing the electrical insulator apparatus to a utility fixture, wherein a pin affixed to the utility fixture engages with an internal cavity of an insulator body of the electrical insulator apparatus; and retaining a portion of the electrical conductor within a receiving notch formed on the insulator body between a first jaw portion, a second jaw portion, and a jaw platform, wherein the portion of the electrical conductor contacts a platform surface of the notch, wherein a plane of a platform surface of the jaw platform is aligned to intersect the internal cavity, wherein the portion of the electrical conductor applies a longitudinal force against the pin within the cavity.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 4A-4D are illustrations of a liner member for use with the apparatus of FIGS. 2-3, in accordance with the second exemplary embodiment of the disclosure.

DETAILED DESCRIPTION

Figure 1:
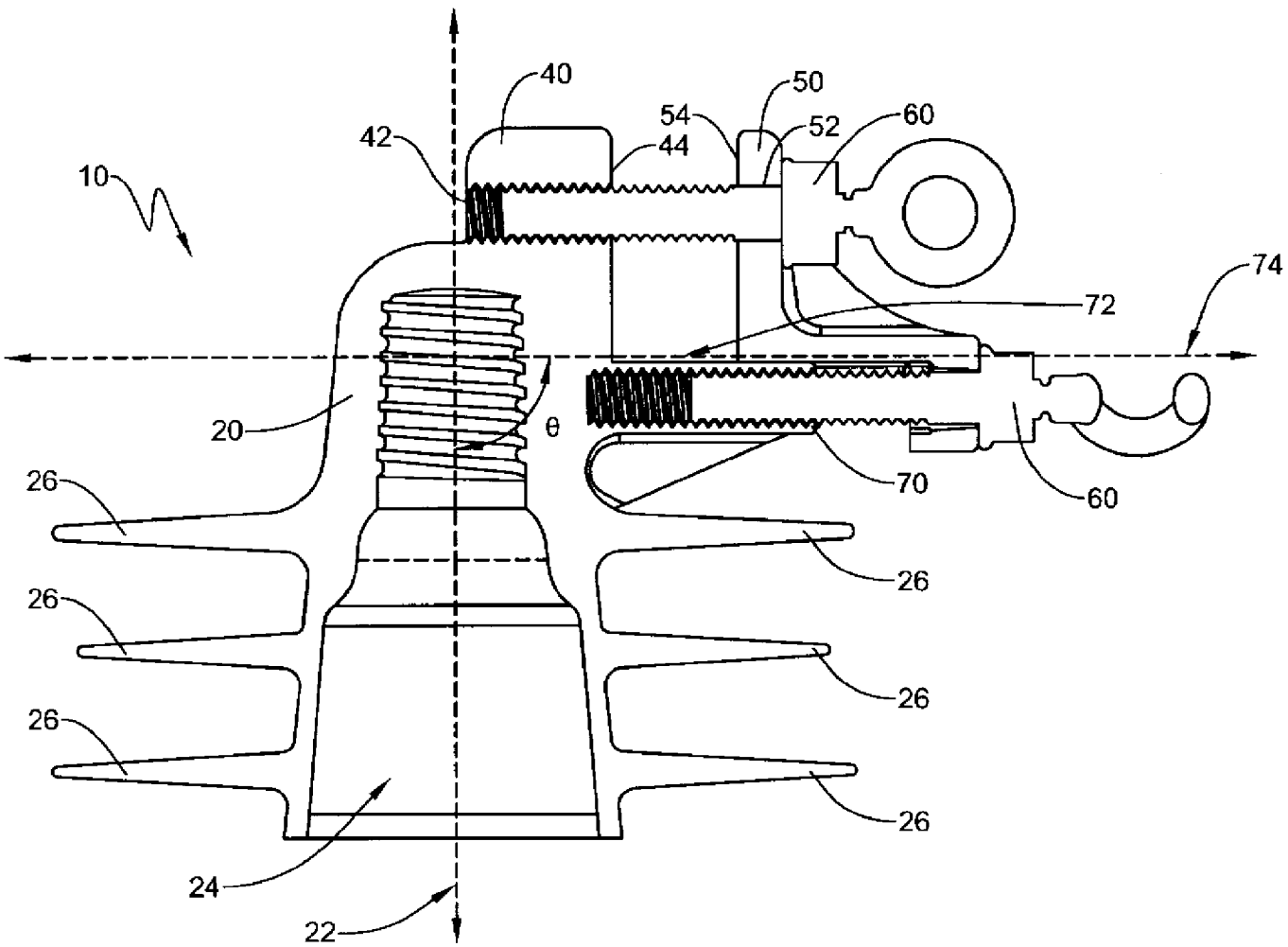
FIG. 1 is a cross-sectional illustration of an electrical insulator apparatus, in accordance with a first exemplary embodiment of the present disclosure.

FIG. 1 is a cross-sectional illustration of an electrical insulator apparatus 10, in accordance with a first exemplary embodiment of the present disclosure. The electrical insulator apparatus 10, which may be referred to simply as 'apparatus 10,' includes an insulator body 20 formed about a central axis 22, the insulator body 20 having an internal cavity 24 and a plurality of spaced fins 26 positioned along an exterior of the insulator body 20. A first jaw portion 40 is positioned on the insulator body 20. A second jaw portion 50 is connected to the first jaw portion 40. At least one fastener 60 is connected between the first and second jaw portions 40, 50. A jaw platform 70 has a platform surface 72, wherein the platform surface 72 is formed at least partially between the first and second jaw portions 40, 50, and wherein a plane 74 substantially aligned with the platform surface 72 intersects the internal cavity 24.

The apparatus 10 may be used to retain electrical conductors, which are used in systems for the transmission and distribution of electrical power. The apparatus 10 may be used to both install and retain electrical conductors along various electrical fixtures, such as utility poles, towers, or other fixtures. The apparatus 10 may be affixed or fastened to any part of the utility fixture, such as to a cross member of the utility fixture. The apparatus 10 may be used in conjunction with any number of other devices that are known and available within the art, and it should be appreciated that other variations beyond this disclosure are also possible. In particular, FIG. 1 illustrates a pin type insulator, but this disclosure can apply to other insulator types, such as line post insulators or similar types of insulator constructions.

The insulator body 20 is used to isolate electrical conductors from a utility fixture. The insulator body 20 is formed about the central axis 22, such that the central axis 22 is positioned approximately through the center point of the insulator body 20. In other words, the central axis 22 may be characterized as running along a length of the insulator body 20, such that is traverses through the ends of the insulator body 20. The insulator body 20 may be constructed from a variety of different materials that are commonly known and readily available within the art. The size of the insulator body 20 may vary depending on the size or voltage rating of the electrical conductor that it is designed to retain.

The internal cavity 24 of the insulator body 20 may be sized to engage with a mounting pin (not shown) which is affixed to a utility structure, such as a cross-arm of a utility pole. The internal cavity 24 may have varying diameters along its length and any portion thereof may have internal threading for engagement with external threads of a mounting pin. While the internal cavity 24 may have different lengths relative to the insulator body 20, it may commonly traverse into the insulator body 20 past the spaced fins 26 and in to an upper portion of the insulator body 20, terminating at a position proximate to the first jaw portion 40. The insulator body 20 may include any number of spaced fins 26 positioned thereon in a variety of configurations. The number or size of the plurality of spaced fins 26 may vary depending on the design of the insulator body 20. For example, the insulator body 20 may have one, two, or three or more fins 26 radially positioned about the insulator body 20 and spaced relative to one another. The size of the fin 26, in particular, the distance from the tip of the fin 26 to its center, may vary between the fins 26 on the insulator body 20.

The first jaw portion 40, second jaw portion 50, and jaw platform 70 may collectively form a notch for receiving the electrical conductor, and are used to secure the electrical conductor to the insulator body 20. The notch formed by the first jaw portion 40, second jaw portion 50, and jaw platform 70 is positioned on an upper portion or upper area of the insulator body 20. While a lower portion or lower area of the insulator body 20 may be affixed to a utility fixture via a mounting pin. The first jaw portion 40 may be positioned removably to or integral with the upper portion of the insulator body 20. Similarly, the second jaw portion 50 may be connected to the first jaw portion 40 with a fixed connection or a movable connection. Commonly, the second jaw portion 50 is movably connected to the first jaw portion 40, thereby allowing the second jaw portion 50 to provide a clamping function relative to the first jaw portion 40, allowing for the electrical conductor to be clamped between the first and second jaw portions 40, 50.

The jaw platform 70 is formed between the first and second jaw portions 40, 50, and has a platform surface 72 as a base surface on which an electrical conductor can be placed. In this configuration, the electrical conductor can be secured between the first and second jaw portions 40, 50, and the platform surface 72 of the jaw platform 70. The platform surface 72 may be a substantially planar surface, such that it is substantially formed along the plane 74. It is noted that the substantially planar surface may include a number of features that are not planar, such as a textured surface, a slight curvature, or other features, none of which detract from the general positioning of the platform surface 72 along the plane 74.

The at least one fastener 60 is connected between the first and second jaw portions 40, 50. The fastener 60 may include a threaded fastener that is threadedly engaged with a threaded hole 42 positioned within at least one of the first jaw portion 40 and the second jaw portion 50. In FIG. 1, the fastener 60 is shown being connected between the first and second jaw portions 40, 50 and threadedly connected within the threaded hole 42 within the first jaw portion 40. It may be common for more than one fastener 60 be used, such as, for example, with one fastener 60 connected between the first and second jaw portions 40, 50 above the platform surface 72 and another fastener 60 connected between the first and second jaw portions 40, 50 below the platform surface 72. The fastener 60 or fasteners 60 may secure the first and second jaw portions 40, 50 in a closed position, or retain them in an open position. Thus, the fastener 60 may control the spacing between the second jaw portion 50 and the first jaw portion 40. For a threaded fastener, when it is rotated, the threads on the end of the fastener 60 in combination with the threaded hole 42 will draw the second jaw portion 50 towards the first jaw portion 40. As is known in the art, it may be preferable for threading on the fasteners to be unique to electrical insulating devices, such as this apparatus 10, to prevent the use of common threaded metallic fasteners, which may harm an electrical conductor within the notch.

As is shown in FIG. 1, the first jaw portion 40 may be formed integrally with the insulator body 20 at an upper portion of the insulator body 20. The first jaw portion 40 has a contact face 44, opposing the second jaw portion 50, which may be contacted by the electrical conductor when it is positioned within the notch. The contact face 44 may extend to the platform surface 72 of the jaw platform 70, and may be formed integral with the jaw platform 70. The contact face 44 may have any size or dimension. Furthermore, as is discussed relative to FIGS. 2-4D, the contact face 44 may support a liner material for increasing frictional contact between the first jaw portion 40 and the electrical conductor.

The second jaw portion 50 may have a hole 52 therein which the threaded fastener 60 can engage with or traverse through. The hole 52 may be aligned with the hole 42 of the first jaw portion 40. A contact face 54 of the second jaw portion 50 may oppose the contact face 44 of the first jaw portion 40, and may extend towards the platform surface 72. When the second jaw portion 50 is fixed to the jaw platform 70, the contact face 54 of the second jaw portion 50 may be formed integral with the jaw platform 70. When the second jaw portion 50 is movable relative to the first jaw portion 40 or the jaw platform 70, the contact face 54 may terminate proximate to the platform surface 72. As is described further relative to other figures of this disclosure, while the second jaw portion 50 may connect to the first jaw portion 40 with the threaded fastener 60, it may also slidably engage with the jaw platform 70.

The platform surface 72 positioned along the plane 74 may be formed at an angle with respect to the insulator body 20 and the central axis 22. The central axis 22 intersects the plane 74 at the upper portion of the insulator body 20. The intersection of the central axis 22 and the plane 74 may be a perpendicular or angled, depending on the design of the apparatus. As is shown in FIG. 1, the angle between the central axis 22 and the plane 74 is identified with reference character θ. In accordance with this disclosure, the angle θ between the central axis 22 and the plane 74 may be measured on the angle formed therebetween. FIG. 1 depicts the angle θ as being substantially perpendicular while other figures of this disclose depict the angle θ as being non-perpendicular.

When the apparatus 10 is positioned to hold an electrical conductor that is being strung along a curve or a bend in the electrical conductor path, the electrical conductor may also produce lateral forces exerted on the first and second jaw portions 40, 50, and the jaw platform 70. For this angled construction, the electrical conductor's horizontal tensions on each side of the insulator body 20 induce a horizontal cantilever force. The plane 74 that is substantially aligned with the platform surface 72 intersects the internal cavity 24 within the insulator body 20. The proximity and the level positioning of the platform surface 72 of the jaw platform 70 with respect to the internal cavity 24 may reduce detrimental moment and any long term creep. By positioning the plane 74 of the platform surface 72 to intersect the internal cavity 24, the cantilever force of the electrical conductor may be fully absorbed by the mounting pin (FIG. 6), where the deflection resistance of the pin material under cantilever force is the limiting factor, not the deflection resistance of the insulator body 20 itself. When line post insulators (not shown), or similar insulators, are used, the plane 72 of the platform surface 72 may intersect a strength member positioned within the internal cavity 24. The strength member may include a central fiberglass rod or similar structure that helps absorb the cantilever force of the electrical conductor, similar to a mounting pin positioned within the internal cavity 24.

The apparatus 10 may provide significant benefits in retaining electrical conductors along angled paths by allowing the lateral forces created by the electrical conductor to be transferred primarily to the mounting pin within the internal cavity 24. When the platform surface 72 is angled relative to the central axis 22, as is discussed relative to FIGS. 8-10B the apparatus may provide even more support for properly retaining the electrical conductor in an angled path. It is noted, however, that the apparatus 10 can be successfully used in both angled and non-angle or tangential conductor paths, which allows a single device to be used for most conductor mounting situations. The ability to use a single device provides significant benefits over the prior art, which require specific mounting devices to be used for tangential portions of a conductor path, and other mounting devices to be used for angled portions of a conductor path.

Examples of using the apparatus 10 relative to the requirements of industry standards are provided. As an electrical conductor is held by the apparatus 10, the weight of the electrical conductor will create a downward force, generally directed centrally to the jaw platform 70. The alignment of the plane 74 of the platform surface 72 with the internal cavity 24 is a primary factor when analyzing the acting conductor loads. In a tangent construction and a steady state, the only load acting on the platform is the conductor's weight. Due to the close proximity of the platform surface 72 to the central axis 22, the moment induced by this vertical load is extremely small and has no impact during the lifetime of the insulator.

Example 1

The following load calculation for a tangent construction is provided as means of clarification. A large conductor and Heavy Loading Zone conditions, in accordance with National Electrical Safety Code (NESC), are applied for the calculation:

TABLE 1

| | |
|---|---|
| Conductor | 954kcmil ACSR, 1.17"OD |
| Conductor Span and Sag | Span 250 ft, Sag 4 ft |
| Conductor Icing | 0.5 inch thickness |
| Total Linear Weight (conductor and ice) | 2.28 lbf/ft |

Vertical load ($L_v$) is given by the formula:

$$L_V = \text{Total Linear Weight} \times \text{Span}$$

$$L_V = 2.28 \times 250 = 570 \text{ lbf}$$

Thus, the acting vertical load upon the apparatus 10 is approximately 600 lbf for a Heavy Loading Zone condition of a tangent configuration.

Common mounting pins, such as Joslyn Catalog No J606Z, J203Z & J207Z, may be used to install the apparatus 10 on the utility fixture. Finite Element Analysis (FEA) may be used to simulate the acting force on the mounting pin and the resultant deflection. FEA with cast steel key mechanical properties, representative of the described mounting pins, shows that for a vertical load of 600 lbf and a standard 6" mounting pin, a deflection angle of 0.86° may occur, which is significantly less than the 10° deflection allowed by industry design practice.

Example 2

This example considers the compliance with the National Electrical Safety Code (NESC) Section 27, table 277-1 "Allowed percentages of strength rating" for insulators, where the maximum allowed service load acting on the insulator is 40% of its published rated value. Within the industry, the bending strength is typically rated to 3000 lbf, hence the 40% NESC allowance computes to 1200 lbf maximum permissible service load. The same FEA analysis as in Example 1 shows that for a vertical load of 1200 lbf, a corresponding mounting pin deflection angle of 1.75° may occur.

Example 3

In another example, the most stringent case is compliance with the State of California General Order GO 95, Rule 44.1 Table 4 "Minimum Safety Factor" for Grade of Construction "A". The minimum safety factor for Line insulators' mechanical loads for Grade "A" is to be 3. The vertical load to consider is then the actual load in Example 1 multiplied by the safety factor which computes to approximately 1800 lbf. The FEA simulation performed as in Example 1 shows that a pin deflection angle of 2.67° may occur which is considerably less than the 10° deflection that is allowed by industry design practice.

Example 4

Considering the same Heavy Loading Zone conditions in the previous examples with the additional condition of 40 mile/hour wind and fixing the maximum mounting pin permissible deflection to 10°, the maximum allowable Line Angle for an angled construction is calculated for common conductor sizes as follows:

TABLE 2

| Size (kcmil or AWG) | Diameter (in.) | Linear Weight (lb/ft) | Type | Line Angle Max (degree) |
|---|---|---|---|---|
| 954 | 1.17 | 1.22 | Bare | 13 |
| 636 | 1.02 | 1.0 | Bare | 15 |
| 477 | 0.86 | 0.656 | Bare | 20 |
| 336 | 0.74 | 0.526 | Bare | 23 |
| 4/0 | 0.56 | 0.291 | Bare | 30 |
| 795 | 1.57 | 1.315 | Covered | 11 |

These calculations show that large line angle configurations for heavy loading conditions are possible with the present disclosure. The mechanical strength and the size of the mounting pin are the limiting factors. Increasing the diameter or choosing a higher Young's modulus for a metal pin will thus increase the permissible line angle while still satisfying the 10° maximum pin deflection limitation.

As a point of comparison to the present disclosure, conventional insulators within the industry support the electrical conductor in a top-saddle position for tangent, small angle configurations, e.g., less than 5°, or configurations with lateral wind forces. The top saddle is centered at some distance above the mounting pin, typically 0.50 inch or more, and the additional wind load component and related conductor blow angle cause a resultant moment and a mounting pin deflection angle larger than that of the present disclosure. The allowable line angle values in the above example exceed the allowable angles calculated for conventional insulators supporting the electrical conductor in a top-saddle. When conventional insulators are used for angled configurations, e.g., greater than 5°, the conductor is commonly placed in a side-saddle position. Similar to the top-saddle position, this side-saddle position in conventional insulators is positioned a distance above the mounting pin. The lateral force of the conductor applied to the conventional insulator above the mounting pin substantially increases the cantilever forces applied to the conventional insulator to undesirable levels. Furthermore, the side-saddle position places the electrical conductor closer in proximity to the utility fixture, when compared to its top-saddle position, and therefore presents the disadvantage of reduced electrical performance.

Thus, the alignment and position of the platform surface 72 of the jaw platform 70 in relation to the internal cavity 24 of the apparatus 10 may be sufficient tangent or angled accommodation of the electrical conductor in accordance to industry standards and provide many benefits over conventional insulators.

Figure 2:
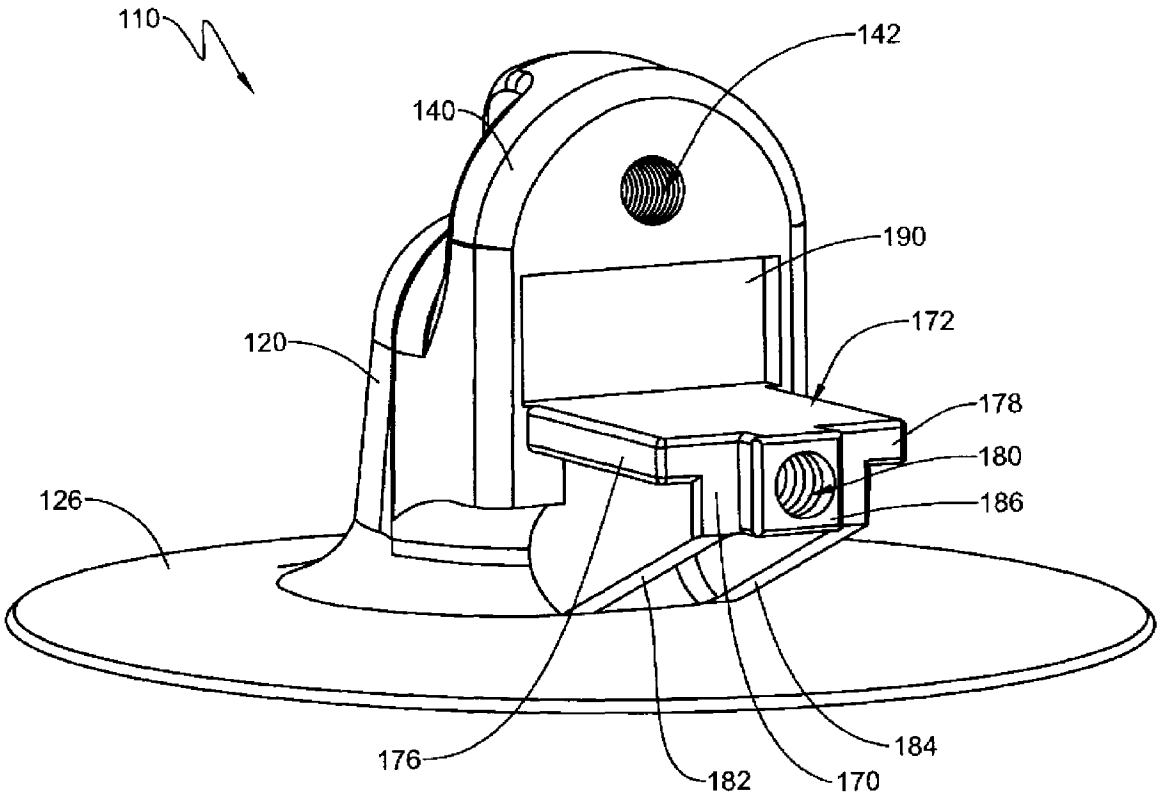
FIG. 2 is a plan view illustration of the first jaw portion of an electrical insulator apparatus, in accordance with a second exemplary embodiment of the present disclosure.
Figure 3:
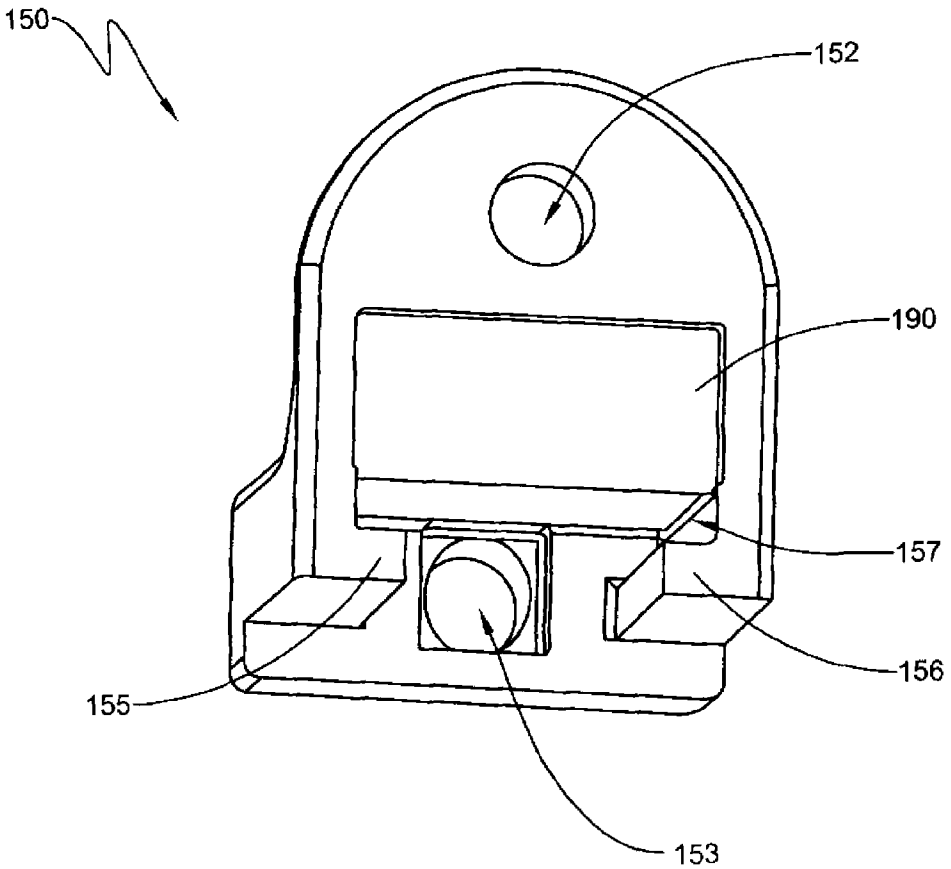
FIG. 3 is a plan view illustration of the second jaw portion of an electrical insulator apparatus, in accordance with the second exemplary embodiment of the present disclosure.

FIG. 2 is a plan view illustration of the first jaw portion 140 of an electrical insulator apparatus 110, in accordance with a second exemplary embodiment of the present disclosure. FIG. 3 is a plan view illustration of the second jaw portion 150 of an electrical insulator apparatus 110, in accordance with the second exemplary embodiment of the present disclosure. The electrical insulator apparatus 110, which may be referred to herein as 'apparatus 110' may be substantially similar to the electrical insulator apparatus 10 of the first exemplary embodiment, and may include any of the structures or functioning described with respect to any embodiment of this disclosure.

As is shown in FIG. 2, the apparatus 110 differs from the apparatus 10 of FIG. 1 by including a pocket 190 within the first jaw portion 140 to retain a liner member (FIG. 4) therein. The pocket 190 is recessed within the first jaw portion 140 and formed perpendicular and leveled with respect to the jaw platform 170 and may be sized to house the liner member securely to ensure a high gripping strength of the electrical conductor. The hole 142 may be positioned above the pocket 190 to receive the fastener in a position above where the liner member will be fitted in the pocket 190. The liner member is discussed in detail relative to FIG. 4. The apparatus 110 may include large radiuses between the components, such as on top and lateral sides of the first jaw portion 140. These large radiuses may provide electrical stress control. Furthermore a large radius transition between the first jaw portion 140 and the plurality of spaced fins 126 may minimize electrical stress in this region.

As can also be seen, the jaw platform 170 having the platform surface 172 may have outer edges that are terminated by two horizontal beams 176, 178. The two horizontal beams 176, 178 may resist uplift motion of the second jaw portion 150 when it is secured in place to the first jaw portion 140 with one or more fasteners (not shown). Additionally, the two horizontal beams 176, 178 may eliminate flexural stress on a fastener engaged with a hole 180 within the jaw platform 170. Below the jaw platform 170, two braces 182, 184 may connect between the insulator body 120 and the jaw platform 170 to provide long term support and creep resistance capability that the jaw platform 170 may be susceptible to under a constant weight (vertical load) of the electrical conductor supported by the apparatus 110. Beneath the platform surface 172, the hole 180 may be positioned within a lateral jaw face 186. The lateral jaw face 186 may protrude beyond the jaw platform 170 to increase fastener thread engagement length when accommodating a large conductor.

As is shown in FIG. 3, the second jaw portion 150 may be designed to engage with the jaw platform 170. For example, the second jaw platform 150 may include two horizontal beams 155, 156 and a rectangular cavity 157 to receive both horizontal beams 176, 178 of the jaw platform 170. Engagement between the rectangular cavity 157 and the two horizontal beams 176, 178 of the jaw platform 170 may block the uplift of the second jaw portion 150. Above the rectangular cavity 157 a pocket 190 may be formed in the second jaw portion 150 to house another liner member (not shown), to ensure a high gripping strength of the electrical conductor when the first and second jaw portions 140, 150 are compressed around the electrical conductor. The second jaw portion 150 may include holes 152 and 153 (FIG. 3), which are aligned with the threaded holes 142, 180 of the first jaw portion 140, respectively, to accommodate the fasteners.

FIGS. 4A-4D are illustrations of a liner member 192 for use with the apparatus 110 of FIGS. 2-3, in accordance with the second exemplary embodiment of the disclosure. In particular, FIG. 4A illustrates a plan view of a liner member 192, while FIGS. 4B-4D illustrate side views of liner members 192 with surface textures. The liner member 192 may be at least partially positioned within the pocket 190 of at least one of the first and second jaw portions 140, 150, but preferably both of the first and second jaw portions 140, 150. The liner members 192 are sized to fit in and be retained by the pocket 190 of the first and second jaw portions 140, 150 of the apparatus 110. The liner member 192 has a face portion 194 positioned to contact the conductor. The boundary of the face portion 194 may have a chamfered edge 196 to guard against conductor damage should conductor movement occur. The face portion 194 may be finished with a texture, ribbing or other geometry suitable to grip the conductor without causing harm. For example, the face portion 194 may be a ribbed pattern (FIG. 4B), an undulating or wave-shaped pattern (FIG. 4C), a friction-enhancing texture, such as sand-paper textured pattern (FIG. 4D), or other suitable pattern, such as raised vertical ribbing, raised diagonal ribbing, and/or raised cross-diagonal ribbing.

By tightening the fasteners, the conductor is secured on the platform surface 172 (FIG. 2) of the jaw platform 170 between each liner member 192, wherein the liner members 192 provide a compression force on the conductor. The compression force magnitude is controlled by the torque applied by the fasteners and by the features present at the face portion 194 of the liner member 192. The compression force magnitude may be selected to be directly proportional to the pulling force required to dislodge the conductor from the gripping mechanism, which may be known within the industry as the conductor holding strength, grip strength or gripping strength, and is herein referred to as grip strength. It may be desirable to select the liner members 192 from a specific material to optimize the grip strength and to reduce, or eliminate, galvanic reaction due to dissimilar metals that may be present in conventional insulator configurations.

Common construction practice for conductor grip strength is to apply the safety rules as described in NESC Section 26 for longitudinal strength. To achieve the NESC strength values, it may be desirable to select a material for the liner member 192 harder than the conductor in order to resist deflection under load and with textured surface or raised features to improve grip strength. The inorganic material as described in this disclosure, preferably with an undulating face pattern (FIG. 4C) and vertical narrow grooved type texturing, may provide a grip strength exceeding 900 lbf for any size of bare conductor and 650 lbf for any covered conductor. Moreover, as the magnitude of the grip strength for a given liner member 192 is also dependent on the torque level used to tighten the fasteners. A correlation chart of torque level to grip strength can be compiled to provide users with the flexibility to achieve a specific grip strength value. Such a feature offers the end-user significant flexibility in customizing grip strength for specific situations and conditions.

In addition to providing the aforementioned hardness and the necessary grip strength, the material selected for the liner member 192 should be chemically inert and stable over time. The liner member material properties are also selected to eliminate galvanic reactions with electrical conductors. An aspect of the present disclosure is to provide compatibility with all types of conductors, such as aluminum, copper and covered, and to provide UV resistance and chemical stability in the presence of moisture and contaminants (e.g. dust, salt, fertilizer or other airborne matter) for the expected lifetime (e.g. 30 years, 40 years, or 50 years, as non-limiting examples). In the outdoor environment, where high humidity and salt-fog conditions may be common, galvanic reaction is expected between metals if their Anodic Index (AI) differs by 0.15 or more. Typical AI values for common materials used in the industry are provided in Table 3:

TABLE 3

| Material | Anodic Index |
|---|---|
| Aluminum | −0.9 |
| Copper | −0.35 |
| Galvanized Steel | −1.2 |

Given the large AI differences between these materials, none can be a suitable universal liner member 192 for all types of conductors aforementioned. Thus, it is preferable for the liner member 192 to be constructed from a material different from a material of the first and second jaw portions 140, 150, and selection of a non-metallic, electrically non-conductive material is preferred. For example, the liner member 192 may be a ceramic type material such as Aluminum Oxide (85% to 99.9% purity), Silicon Nitride, Cordierite, Mullite, Steatite, Zirconium Oxide or some other suitable material. The liner member 192 may be an organic based composite such as UV-stabilized abrasive-filled rubber, glass fiber filled Nylon, or other suitable material.

Figure 5:
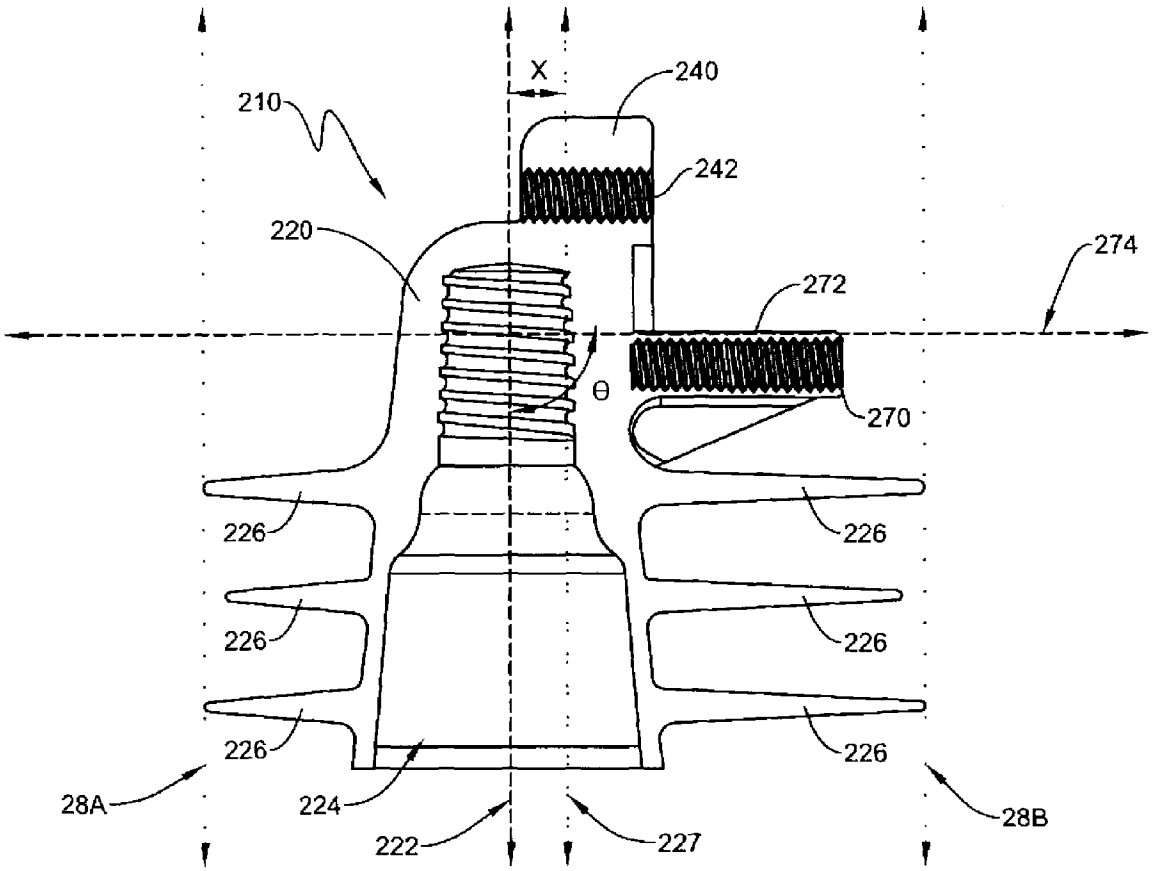
FIG. 5 is a cross-sectional illustration of an electrical insulator apparatus, in accordance with a third exemplary embodiment of the present disclosure.

FIG. 5 is a cross-sectional illustration of an electrical insulator apparatus 210, in accordance with a third exemplary embodiment of the present disclosure. The electrical insulator apparatus 210, which may be referred to herein as 'apparatus 210' may be substantially similar to the electrical insulator apparatus of any other exemplary embodiment herein, and may include any of the structures or functioning described with respect to any embodiment of this disclosure. The apparatus 210 includes an insulator body 220 formed about a central axis 222, the insulator body 220 having an internal cavity 224 and a plurality of spaced fins 226 positioned along an exterior of the insulator body 220. A first jaw portion 240 is positioned on the insulator body 220. A second jaw portion 250 (FIGS. 6-7) is connected to the first jaw portion 240. At least one fastener 260 (FIGS. 6-7) is connected between the first and second jaw portions 240, 250. A jaw platform 270 has a platform surface 272, wherein the platform surface 272 is formed at least partially between the first and second jaw portions 240, 250, and wherein a plane 274 substantially aligned with the platform surface 272 intersects the internal cavity 224.

Figure 6:
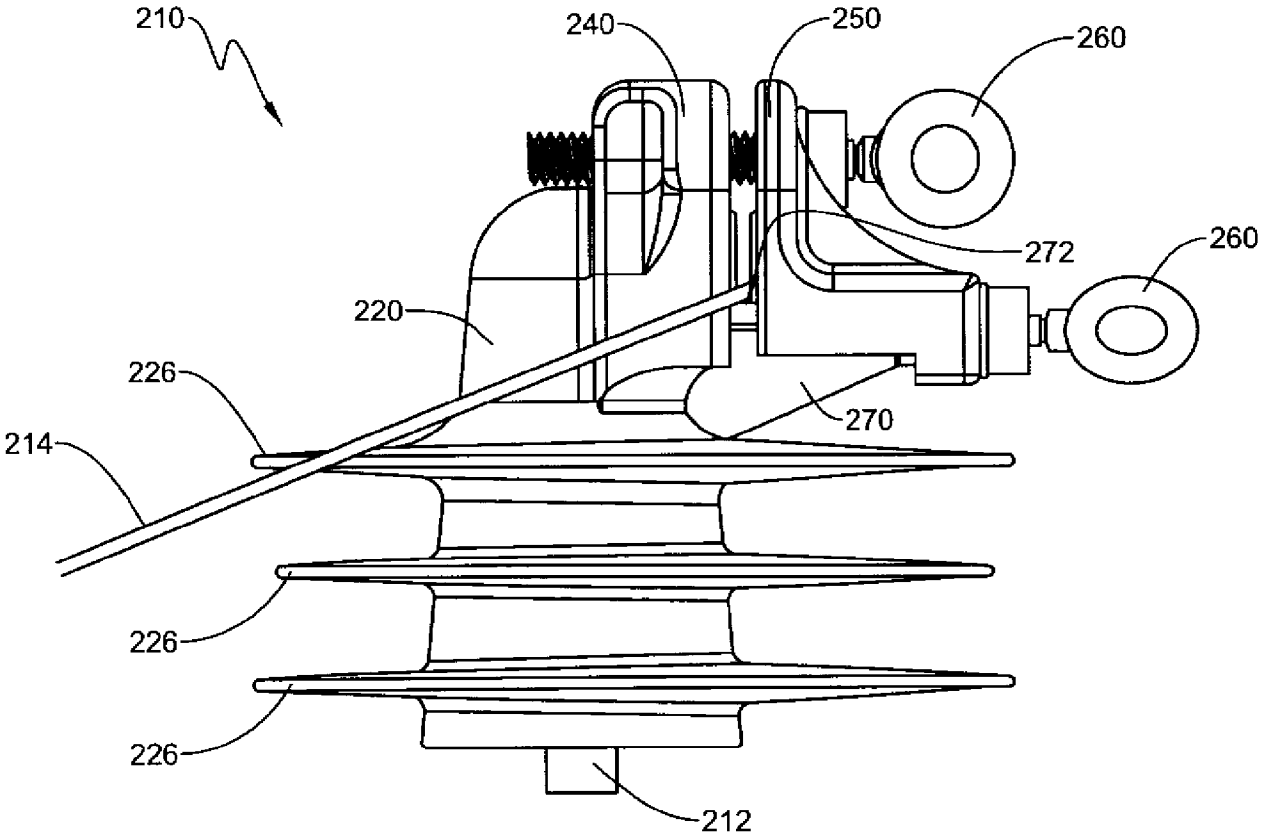
FIG. 6 is a side view illustration of the electrical insulator apparatus of FIG. 5, in accordance with the third exemplary embodiment of the present disclosure.

As is discussed with respect to FIG. 1, the insulator body 220 of FIG. 6 is used to isolate electrical conductors from the utility fixture, utilizing a plurality of spaced fins 226 positioned thereon. The insulator body 220 is formed about the central axis 222, such that the central axis 222 is positioned approximately through the center point of the insulator body 220. FIG. 1 shows the plurality of spaced fins 226 positioned coaxial relative to the central axis 222 of the insulator body 220. As shown in FIG. 5, the plurality of spaced fins 226 may be positioned non-coaxial relative to the central axis 222, such that the central axis 222 is parallel, but not aligned with the fin axis 227, i.e., the axis of the plurality of spaced fins 226. The distance between the central axis 222 and the fin axis 227 may be referred to as an offset distance, which is identified with reference character X in FIG. 5.

In accordance with this disclosure, the offset distance X between the central axis 222 and the fin axis 227 may be a value such as to balance or optimize the resistance path to ground, hereinafter referred to as leakage distance, as measured from the jaw platform 270 across the body of the apparatus 210 to the inner internal cavity 224, in all directions across the plurality of spaced fins 226. As an example, the offset distance X may be 0.50 inch or other desired value (e.g. 0.20 inch, 0.40 inch, 0.60 inch or any other suitable value). The offset distance X may vary depending on the size or voltage rating of the electrical conductor that it is designed to retain. For example, the offset distance X may be selected to adjust the leakage distance for a range of conductor sizes (e.g. No. 6 AWG to 2/0 AWG, No. 1/0 AWG to 4287 kcmil, 336 kcmil to 795 kcmil, or any other suitable range) or for a range of system voltages (e.g. 5 kV to 15 kV, 15 kV to 25 kV, 25 kV to 35 kV or any other suitable range). Conventional devices have fins that are coaxial with an insulator device. The non-coaxial positioning of the fins 226 to the insulator body 220 of the apparatus 210 provide improved leakage distance over these conventional devices, in addition to providing a sufficient tangent or angled accommodation of the electrical conductor.

Figure 7:
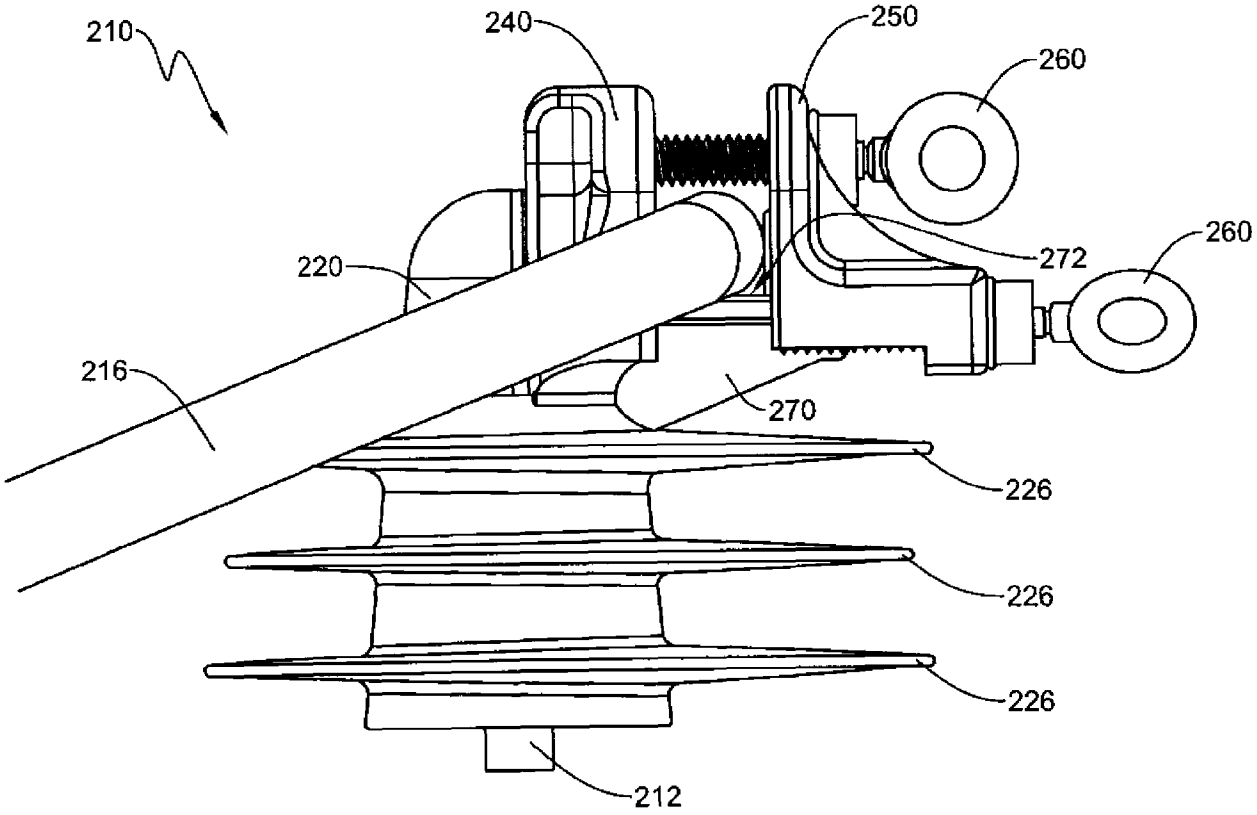
FIG. 7 is a side view illustration of the electrical insulator apparatus of FIG. 5, in accordance with the third exemplary embodiment of the present disclosure.

FIG. 6 is a side view illustration of the electrical insulator apparatus 210 of FIG. 5, in accordance with the third exemplary embodiment of the present disclosure. FIG. 7 is a side view illustration of the electrical insulator apparatus 210 of FIG. 5, in accordance with the third exemplary embodiment of the present disclosure. Both FIGS. 6-7 illustrate the apparatus 210 in use with a mounting pin 212 for attachment with a utility fixture and with an electrical conductor. FIG. 6 depicts the apparatus 210 in use with a small diameter electrical conductor 214, whereas FIG. 7 depicts the apparatus 210 in use with a large diameter conductor 216. Relative to FIGS. 6-7, the electrical conductors 214, 216 may be positioned within the notch formed between the first and second jaw portions 240, 250, and resting on the platform surface 272. The fasteners 260 may then be tightened to close the first and second jaw portions 240, 250 on the electrical conductor 214, 216 to frictionally retain it in place. One or more liner members may be included on the inner surface of the first and second jaw portions 240, 250 to make physical contact with the electrical conductor 214, 216, as discussed relative to FIGS. 2-4D. It may be desirable to size the first and second jaw portions 240, 250 and the liner members to provide proper positioning to accommodate a large range of electrical conductor 214, 216 sizes.

The apparatus 210 of FIG. 6 is shown in the closed position with a small diameter electrical conductor 214, such as a No. 6 AWG solid, between the first and second jaw portions 240, 250, such that the notch formed between the first and second jaw portions 240, 250 and the platform surface 272 of the jaw platform 270 is small. It may be desirable to position the liner members such that their lower edge is fixed slightly above the jaw platform 270 and below the centerline of the electrical conductor 214, thus providing direct physical contact with small diameter conductors. The apparatus 210 of FIG. 7 is shown in the closed position with a large diameter electrical conductor 216, such as a 795 kcmil covered conductor, between the first and second jaw portions 240, 250, such that the notch formed between the first and second jaw portions 240, 250 and the jaw platform 270 is large. It may be desirable to size the height of the liner members such that the lower edge is fixed slightly above the jaw platform 270 and the upper edge is fixed above the centerline of the electrical conductor 216. The liner members may be capable of providing direct physical contact with a full range of conductor sizes, from small to large diameter.

The positional nature of the jaw platform 270 with respect to the insulator body 220 may allow for the apparatus 210 to be used to string electrical conductors in various configurations, namely along paths that include bends and curves. In other words, the apparatus 210 may also serve an additional function as an installation tool suitable for the conductor prior to securing in place. For example, the apparatus 210 may allow for stringing electrical conductors along paths with bends or curves that are greater than 6°, or greater than other angles, such as greater than 20°, 30°, or 45° when used with suitable mounting hardware. When the apparatus 210 is used to angularly string an electrical conductor, the force that the electrical conductor 214, 216 applies to the apparatus may be transferred into the insulator body 220 via the first jaw portion 240 and the jaw platform 270, such that the force is applied angularly to the insulator body 220. The positioning of the jaw platform 270 with respect to the insulator body 220 and the internal cavity 224 may help counteract the force applied by the electrical conductor 214, 216 better than a conventional insulator device, e.g., a vise-top insulator, since the insulator body 220 may have a greater resistance to lateral forces created by the electrical conductor due to the bend in the stringing path.

Figure 8:
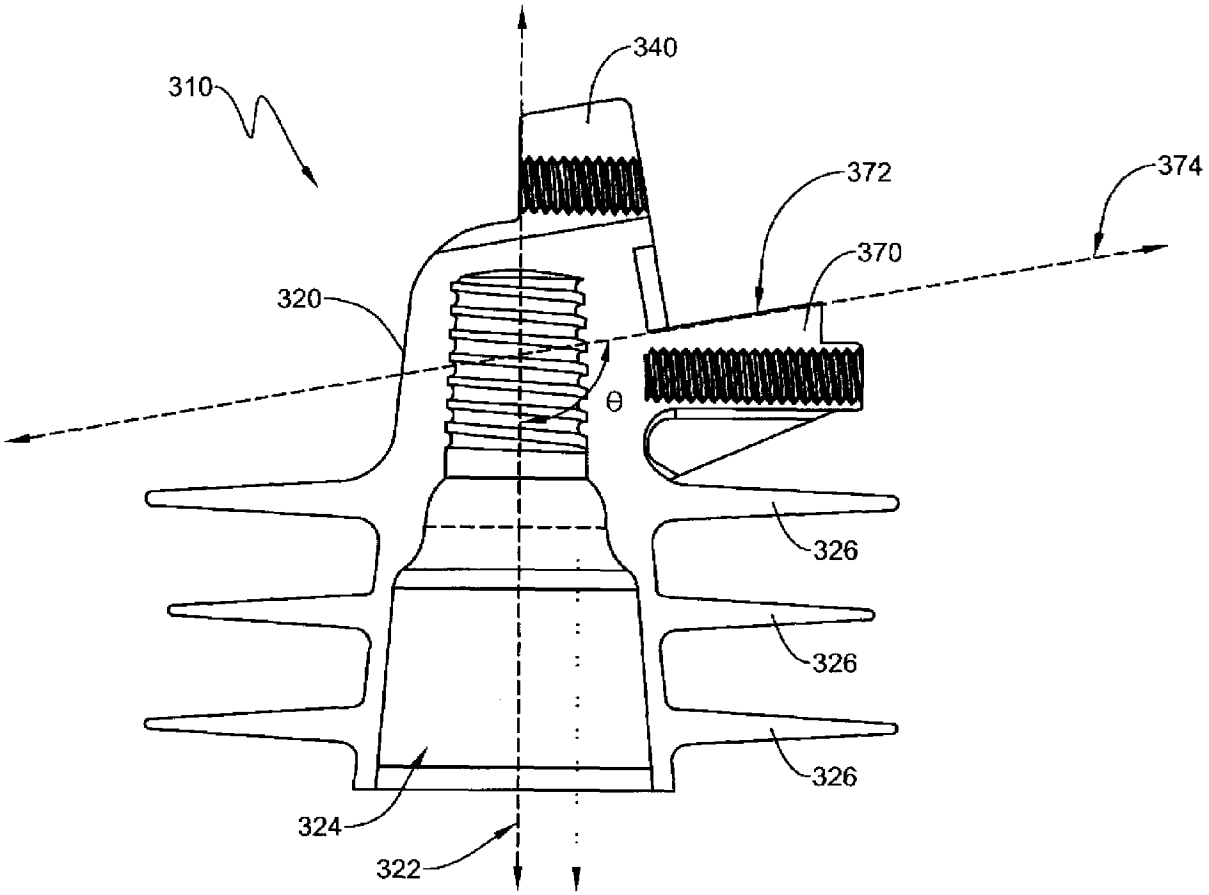
FIG. 8 is cross-sectional illustration of an electrical insulator apparatus, in accordance with a fourth exemplary embodiment of the present disclosure.

FIG. 8 is cross-sectional illustration of an electrical insulator apparatus 310, in accordance with a fourth exemplary embodiment of the present disclosure. The electrical insulator apparatus 310, which may be referred to herein as 'apparatus 310' may be substantially similar to the electrical insulator apparatus of any other exemplary embodiment herein, and may include any of the structures or functioning described with respect to any embodiment of this disclosure. The apparatus 310 includes an insulator body 320 formed about a central axis 322, the insulator body 320 having an internal cavity 324 and a plurality of spaced fins 326 positioned along an exterior of the insulator body 320. A first jaw portion 340 is positioned on the insulator body 320. A second jaw portion (not shown) is connected to the first jaw portion 340, and at least one fastener (not shown) is connected between the first jaw portion 340 and the second jaw portion. A jaw platform 370 has a platform surface 372, wherein the platform surface 372 is formed at least partially between the first jaw portion 340 and the second jaw portion, and wherein a plane 374 substantially aligned with the platform surface 372 intersects the internal cavity 324.

As is discussed with respect to FIG. 1, the jaw platform 370 is aligned along the plane 374 which intersects the internal cavity 324. In FIG. 1, this angle θ was 90°, but the plane 374 may be oriented at other angles relative to the central axis 322 while still intersecting the internal cavity 324. For example, the intersection of the central axis 322 and the plane 374 may be a non-perpendicular intersection. The angle θ may include a plurality of angles between the plane 374 of the platform surface 372 of the jaw platform 370 and the central axis 322, preferably between 60° and 150°, but including any angle between 6° and 184°, as measured between the angle formed between the plane 374 and the central axis 322. The angled nature of the platform surface 372 with respect to the central axis 322 may enhance the ability of the apparatus 310 to be used to string electrical conductors in various configurations, namely along paths that include bends and curves, as discussed further relative to FIGS. 9A-9D.

Figure 9A:
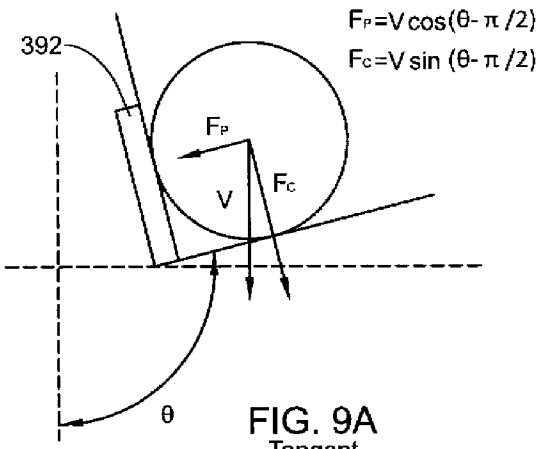
FIGS. 9A-9D are schematic diagrams of the forces created by an electrical conductor relative to a variety of angles between the platform surface and the central axis of the apparatus of FIG. 8, in accordance with the fourth exemplary embodiment of the present disclosure.
Figure 9B:
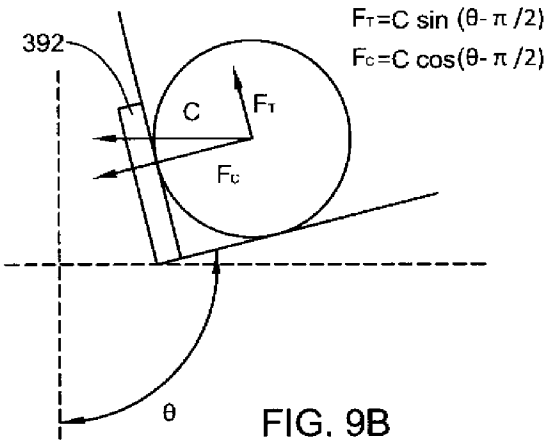
Figure 9C:
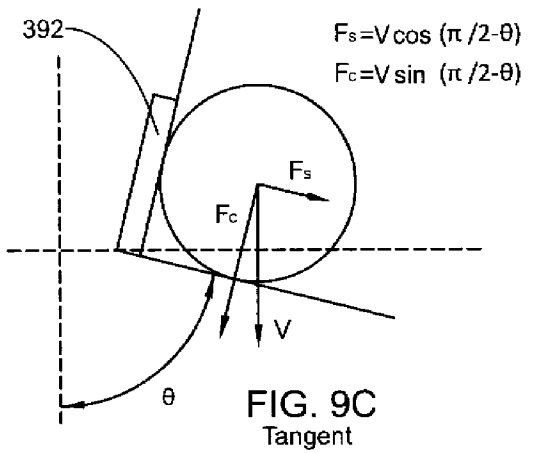
Figure 9D:
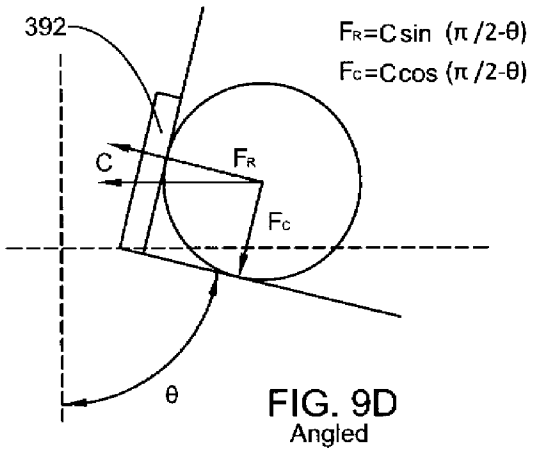

FIGS. 9A-9D are schematic diagrams of the forces created by an electrical conductor relative to a variety of angles between the platform surface 372 and the central axis 322 of the apparatus 310 of FIG. 8, in accordance with the fourth exemplary embodiment of the present disclosure. In particular, FIGS. 9A and 9B represent the case of an angle θ>90° in tangential and angled constructions, respectively. FIGS. 9C and 9D represent the case of an angle θ<90° also in tangential and angled constructions, respectively.

In all four illustrations the vector force components are represented and expressed as a function of the angle θ, where V is the vertical force in the tangent case and C is the cantilever force in the angled case. For θ>90°, in the tangent configuration of FIG. 9A, the $F_p$ component assists in maintaining the conductor against the liner member 392 securing it in place, however, in the angled configuration of FIG. 9B, the $F_T$ contributes to the conductor's uplift in turbulent conditions (e.g. strong wind, galloping, falling tree on conductor, etc.). For θ<90°, in the tangent configuration of FIG. 9C, the $F_c$ force causes the conductor to slide back but the fastener is mechanically rated in traction mode to maintain the conductor securely in compression against the liner member 392. However, in the angled configuration of FIG. 9D, the component $F_R$ assists the jaws in holding the conductor in place. Depending on the use of the insulator and the construction considered, one can select the optimum angle θ. Thus, the angled jaw platform 370 of the apparatus 310 may therefore provide a sufficient tangent or angle accommodation of the electrical conductor.

Figure 10B:
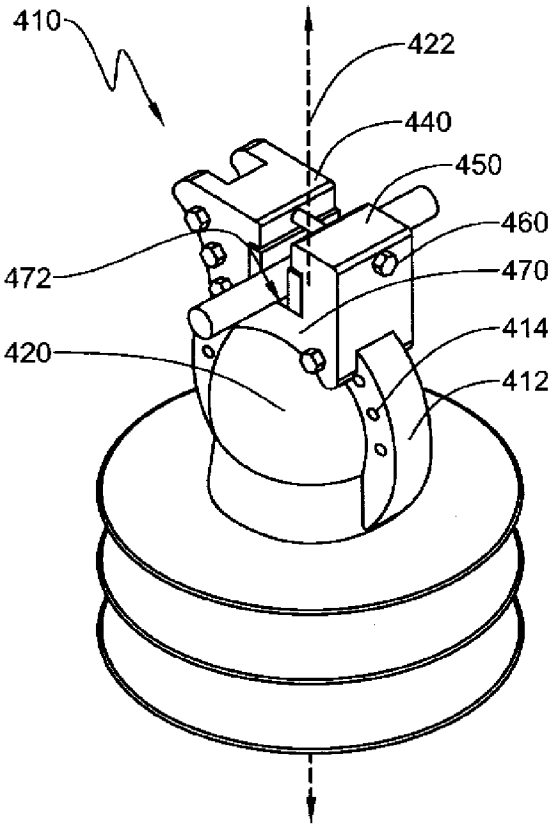
FIGS. 10A-10B are plan view illustrations of an electrical insulator apparatus, in accordance with a fifth embodiment of the present disclosure.
Figure 10A:
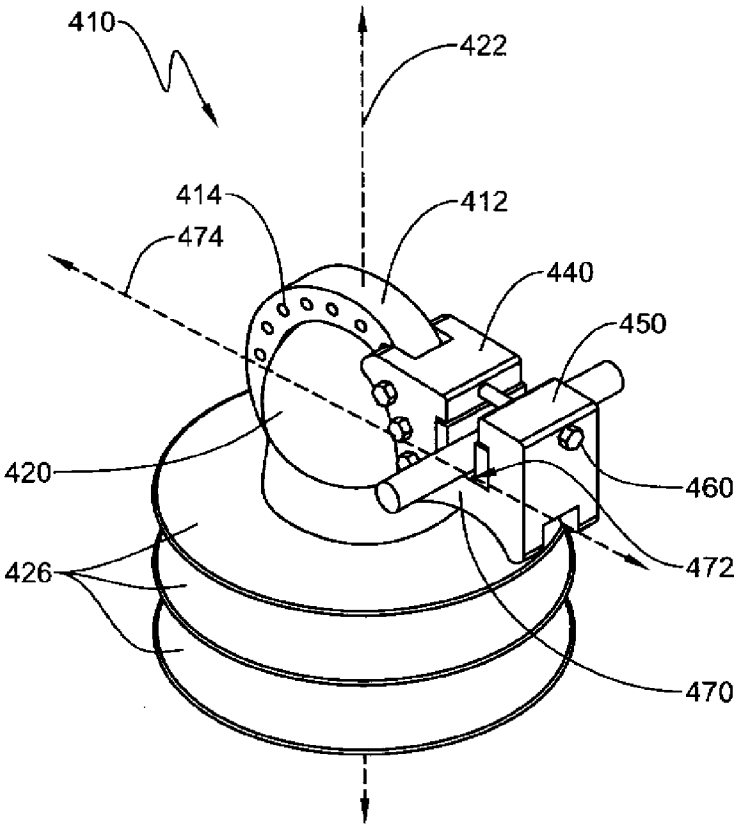

FIGS. 10A-10B are plan view illustrations of an electrical insulator apparatus 410, in accordance with a fifth embodiment of the present disclosure. The electrical insulator apparatus 410, which may be referred to herein as 'apparatus 410' may be substantially similar to the electrical insulator apparatus of any other exemplary embodiment herein, and may include any of the structures or functioning described with respect to any embodiment of this disclosure. The apparatus 410 includes an insulator body 420 formed about a central axis 422, the insulator body 420 having a plurality of spaced fins 426 positioned along an exterior of the insulator body 420. A first jaw portion 440 is positioned on the insulator body 420. A second jaw portion 450 is connected to the first jaw portion 440. At least one fastener 460 is connected between the first jaw portion 440 and the second jaw portion 450. A jaw platform 470 has a platform surface 472, wherein the platform surface 472 is formed at least partially between the first jaw portion 440 and the second jaw portion 450, and wherein a plane 474 substantially aligned with the platform surface 472 intersects the internal cavity.

The apparatus 410 includes a rail 412 formed on the insulator body 420 which the first jaw portion 440, second jaw portion 450, and the jaw platform 470 can be positioned along. In FIGS. 10A-10B, the first jaw portion 440, second jaw portion 450, and the jaw platform 470 are shown integral with one another, as one unitary structure, collectively referred to as a gripping mechanism. However, it is noted that these components may also be formed separately and connected together. The rail 412 is formed radially about the internal cavity 424 such that the gripping mechanism can be located in the side-saddle position (FIG. 10A) or a top-saddle position (FIG. 10B), or any position therebetween. The rail 412 may include a plurality of holes 414 radially spaced thereon, which allow fasteners 460 to connect the gripping mechanism to the rail 412. Accordingly, the use of the rail 412 with the gripping mechanism to be movable about the insulator body 420, thereby allowing the user to select the optimal angular position desired for a particular use.

Figure 11:
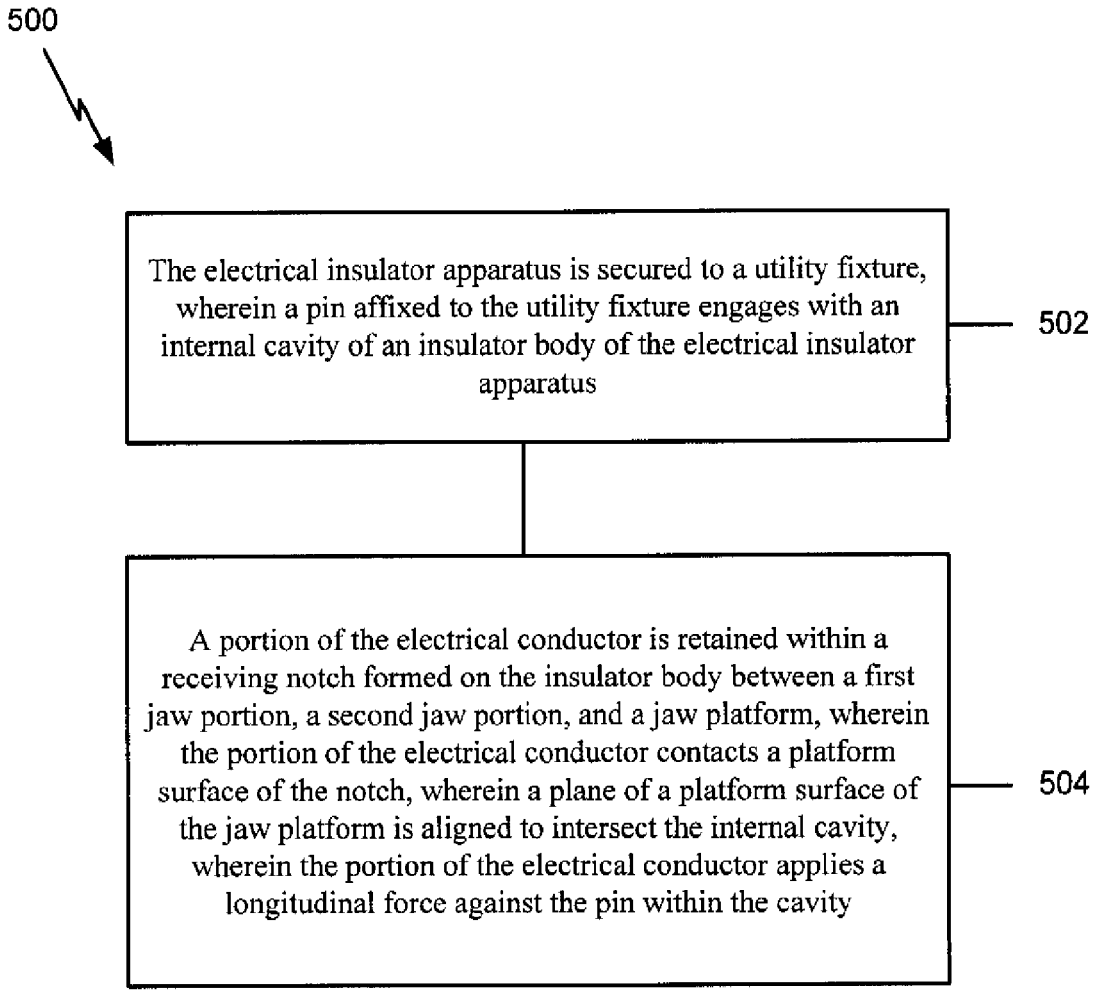
FIG. 11 is a flowchart illustrating a method of retaining an electrical conductor with an electrical insulator, in accordance with a sixth exemplary embodiment of the disclosure.

FIG. 11 is a flowchart 500 illustrating a method of retaining an electrical conductor with an electrical insulator apparatus, in accordance with a sixth exemplary embodiment of the disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 502, the electrical insulator apparatus is secured to a utility fixture, wherein a pin affixed to the utility fixture engages with an internal cavity of an insulator body of the electrical insulator apparatus. A portion of the electrical conductor is retained within a receiving notch formed on the insulator body between a first jaw portion, a second jaw portion, and a jaw platform, wherein the portion of the electrical conductor contacts a platform surface of the notch, wherein a plane of a platform surface of the jaw platform is aligned to intersect the internal cavity, wherein the portion of the electrical conductor applies a longitudinal force against the pin within the cavity (block 504). The method may include any additional step, process, or function, including any disclosed relative to any figure of this disclosure. For example, the plane of the platform surface may be angled substantially between 60° and 150° relative to a central axis of the insulator body and the longitudinal force applied against the pin may be dependent on an angle size of the angle. The longitudinal force may be 500 lbf or greater.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An electrical insulator apparatus comprising:

an insulator body formed about a central axis, the insulator body having an internal cavity and a plurality of spaced fins positioned along an exterior of the insulator body;

a first jaw portion positioned on the insulator body;

a second jaw portion connected to the first jaw portion;

at least one fastener connected between the first and second jaw portions; and a jaw platform having a platform surface, wherein the platform surface is formed at least partially between the first and second jaw portions and slidably engaged with the second jaw portion, wherein a plane substantially aligned with the platform surface intersects the internal cavity, and wherein the second jaw portion is adapted to slide along the jaw platform while maintaining contact with the platform surface.

2. The electrical insulator apparatus of claim 1, wherein the plane of the platform surface is angled substantially between 60° and 150° relative to the central axis of the insulator body.

3. The electrical insulator apparatus of claim 1, wherein the second jaw portion is movably connected to the first jaw portion.

4. The electrical insulator apparatus of claim 1, wherein the at least one fastener between the first and second jaw portions controls a spacing between the second jaw portion and the first jaw portion.

5. The electrical insulator apparatus of claim 1, wherein the at least one fastener further comprises a threaded fastener, wherein the threaded fastener is threadedly engaged with a threaded hole positioned within at least one of the first jaw portion and the second jaw portion.

6. The electrical insulator apparatus of claim 1, wherein the at least one fastener connected between the first and second jaw portions further comprises a first fastener connected between the first and second jaw portions above the platform surface and a second fastener connected between the first and second jaw portions below the platform surface.

7. The electrical insulator apparatus of claim 1, wherein the internal cavity of the insulator body further comprises an internally threaded cavity.

8. The electrical insulator apparatus of claim 1, wherein the internal cavity is formed about the central axis of the insulator body.

9. The electrical insulator apparatus of claim 1, wherein the plurality of spaced fins positioned along an exterior of the insulator body are formed about a central fin axis, wherein the central fin axis is non-coaxial with the central axis of the insulator body.

10. The electrical insulator apparatus of claim 9, wherein an offset distance between the central fin axis and the central axis of the insulator body is selected based on resistance optimization.

11. The electrical insulator apparatus of claim 1, further comprising at least two bracing structure connected between the insulator body and the jaw platform to support the jaw platform.

12. The electrical insulator apparatus of claim 11, wherein the platform surface of the jaw platform extends laterally beyond each of the at least two bracing structures.

13. The electrical insulator apparatus of claim 1, further comprising a cavity within the second jaw portion, the cavity sized to receive a distal end of the jaw platform therein, wherein a proximate end of the jaw platform is integral with the first jaw portion.

14. The electrical insulator apparatus of claim 1, wherein the first jaw portion is positioned on a rail formed on the insulator body radially about the internal cavity, wherein the first jaw portion is locatable between a plurality of positions on the rail.

15. The electrical insulator apparatus of claim 1, further comprising at least one liner member positioned within at least one of the first and second jaw portions.

16. The electrical insulator apparatus of claim 15, further comprising a recessed pocket positioned within the at least one of the first and second jaw portions, wherein the at least one liner member is at least partially positioned within the recessed pocket.

17. The electrical insulator apparatus of claim 15, wherein the at least one liner member is constructed from a material different from a material of the first and second jaw portions.

18. The electrical insulator apparatus of claim 15, wherein the at least one liner member is constructed from at least one of a chemically inert material and a non-conductive material.

19. The electrical insulator apparatus of claim 15, wherein the at least one liner member is constructed from at least one of aluminum oxide, ceramic, and silicon nitride.

20. The electrical insulator apparatus of claim 15, wherein the at least one liner member further comprises a conductor contact face, wherein the conductor contact face has at least one of an undulating geometry, a raised vertical ribbing, a raised diagonal ribbing, a raised cross-diagonal ribbing, and a friction-enhancing texture.

21. The electrical insulator apparatus of claim 1, further comprising a pin positioned within the internal cavity, wherein the plane substantially aligned with the platform surface intersects the pin within the internal cavity.

22. The electrical insulator apparatus of claim 1, further comprising a strength member positioned within the internal cavity, wherein the plane substantially aligned with the platform surface intersects the strength member within the internal cavity.

23. The electrical insulator apparatus of claim 22, wherein the strength member further comprises a central fiberglass rod.

24. An electrical insulator apparatus for side-saddle mounting of a conductor, the electrical insulator apparatus comprising:

an insulator body formed about a central axis, the insulator body having an threaded internal cavity sized to receive a mounting pin;

a plurality of spaced fins positioned radially about the threaded internal cavity along an exterior of the insulator body;

a first jaw portion formed integral with the insulator body;

a second jaw portion movably engaged to the first jaw portion;

a jaw platform formed between the first and second jaw portions and having a substantially planar platform surface, wherein the first jaw portion, the second jaw portion, and the jaw platform form a conductor-receiving notch, wherein a plane substantially aligned with the substantially planar platform surface intersects the internal cavity, and wherein the second jaw portion is adapted to slide along the substantially planar platform surface while maintaining contact with the substantially planar platform surface;

a first threaded fastener engaged between the first and second jaw portions in a position above the plane aligned with the substantially planar platform surface; and a second threaded fastener engage between the first and second jaw portions in a position below the plane aligned with the substantially planar platform surface.

25. The electrical insulator apparatus of claim 24, further comprising a strength member positioned within the internal cavity, wherein the plane substantially aligned with the platform surface intersects the strength member within the internal cavity.

26. A method of retaining an electrical conductor with an electrical insulator apparatus, the method comprising:

securing the electrical insulator apparatus to a utility fixture, wherein a pin affixed to the utility fixture engages with an internal cavity of an insulator body of the electrical insulator apparatus; and retaining a portion of the electrical conductor within a receiving notch formed on the insulator body between a first jaw portion, a second jaw portion, and a jaw platform slidably engaged with the second jaw portion, wherein the portion of the electrical conductor contacts a platform surface of the jaw platform, wherein a plane of the platform surface of the jaw platform is aligned to intersect the internal cavity, wherein the second jaw portion is adapted to slide along the platform surface of the jaw platform while maintaining contact with the platform surface of the jaw platform, and wherein the portion of the electrical conductor applies a longitudinal pulling force against the pin within the cavity.

27. The method of claim 26, wherein the plane of the platform surface is angled substantially between 60° and 150° relative to a central axis of the insulator body.

28. The method of claim 26, wherein the electrical insulator is positioned at an angle within a run of the electrical conductor, wherein the longitudinal pulling force applied against the pin is dependent on an angle size of the angle.

29. The method of claim 26, wherein the electrical conductor is a bare conductor, and wherein the longitudinal pulling force is at least 700 lbf.

30. The method of claim 26, wherein electrical conductor is a covered conductor, and wherein the longitudinal pulling force is at least 500 lbf.

* * * * *